United States Patent [19]

Goncalves

[11] Patent Number: 4,579,153

[45] Date of Patent: Apr. 1, 1986

[54] DROP DISPENSER

[75] Inventor: Antonin L. Goncalves, Groslay, France

[73] Assignee: The French joint stock company "L'Oreal" , Paris, France

[21] Appl. No.: 628,564

[22] Filed: Jul. 6, 1984

[30] Foreign Application Priority Data

Jul. 13, 1983 [FR] France ..... 83 11700

[51] Int. Cl.[4] ..... B65D 47/18

[52] U.S. Cl. ..... 141/23

[58] Field of Search ..... 141/2, 23, 24

[56] References Cited

U.S. PATENT DOCUMENTS

| | | | |
|---|---|---|---|
| 1,241,207 | 9/1917 | Gilber | 141/23 X |
| 2,311,367 | 2/1943 | Chambers | 141/24 X |
| 2,781,063 | 2/1957 | Williams | 141/24 |
| 3,168,913 | 2/1965 | Eagles | 141/23 |
| 3,312,255 | 4/1967 | Miller | 141/24 |
| 3,820,576 | 6/1974 | Torrent | 141/24 |

FOREIGN PATENT DOCUMENTS

| | | | |
|---|---|---|---|
| 176470 | 3/1953 | Austria | 141/24 |
| 0067605 | 12/1982 | European Pat. Off. . | |
| 1051149 | 2/1959 | Fed. Rep. of Germany . | |
| 2000973 | 9/1969 | France . | |
| 2137861 | 12/1972 | France . | |
| 2493515 | 10/1980 | France . | |
| 1379928 | 1/1975 | United Kingdom . | |
| 1510081 | 5/1978 | United Kingdom . | |

*Primary Examiner*—Stephen Marcus
*Assistant Examiner*—Mark Thronson
*Attorney, Agent, or Firm*—Cushman, Darby & Cushman

[57] ABSTRACT

A drop dispenser for liquid or pasty substances such as beauty creams has a bottle and a stoppering device in which the stoppering device includes a piston spring biased to resist depression of the piston to dispense the contents of the bottle drop-by-drop.

5 Claims, 6 Drawing Figures

DROP DISPENSER

FIELD OF THE INVENTION

The present invention relates to a drop dispenser capable of dispensing not only liquid substances but also pasty substances such as beauty creams.

PRIOR ART

Conventional drop dispensers are only suitable for the dispensing of liquids; they comprise a reservoir for the liquid substance to be dispensed, a stoppering capsule for this reservoir, a tube integral with this capsule dipping into the liquid contained in the reservoir and opening out at the top part into a chamber integral with the cap. This chamber is delimited by a wall of a plastics material and it has the shape of a cylinder coaxial with the capsule and closed at its upper end by an ogive shaped wall. By successive manual pressures on the elastic wall delimiting the above mentioned chamber, while the tube is immersed in the substance, a partial vacuum is produced in the chamber, causing the liquid substance to rise in the tube. To dispense this substance, it is then sufficient to press slightly on the elastic membrane to cause the contents of the tube to escape drop-by-drop from the tube.

With such devices, the partial vacuum produced in the chamber would not be sufficient if it is desired to be able to draw up a high viscosity substance (i.e. one having a viscosity appreciably greater than water). Another drawback of this device is that the quantity of the substance drawn up into the tube is never the same on each occasion because it depends on the force exerted on the elastic membrane. Moreover, the elastic membrane is subject to wear.

The French Patent Application No. 2000973 (FIRMENICH) describes a bottle provided with a pipette stopper capable of supporting a considerable difference in pressure between its interior and the ambient atmosphere, without letting the contents escape, which happens, for instance, when this bottle is placed in an unpressurised compartment of an aircraft flying at high altitudes. For this purpose, the pipette stopper comprises a rigid hollow component forced into the bottle, an elastic pliable compartment accommodated within this component and joined to a pipette which enters the bottle when the stopper is screwed on, and a sealing element disposed against the hollow component and intended to be squeezed between the hollow component and the bottle to ensure leakproof closure of the bottle when the stopper is screwed down. The stopper has an opening allowing the pliable chamber to be squeezed so as to remove the air therefrom, then to refill the pipette with the liquid contained in the bottle when the pressure drops, and finally to evacuate the liquid from the pipette.

While this pipette stopper makes it possible to dispense more viscous media, the fact still remains that it, too, is not suitable for the dispensing of substances with a pasty consistency because, in the same way as in the conventional drop dispensers, the chamber in which the low pressure is produced is bounded by a pliable bellows-shaped membrane. Moreover, it is not possible to cause constant doses of the substance to be drawn up into the tube, and the membrane is also subject to wear as the pipette stopper is manipulated.

OBJECT OF THE INVENTION

The present invention aims to overcome these drawbacks. It is a further object of the present invention to provide a drop dispenser in which the variable volume compartment is no longer bounded by a deformable membrane, subject to wear, but instead the compartment is delimited by means of a fixed wall joined to the upper part of the tube and by a piston sliding in a leakproof manner in the said compartment; the piston is restored to its rest position by a spring as soon as the user relaxes the pressure on the said piston.

It is a further object of the invention to enable a sufficiently strong partial vacuum to be created in the compartment to produce the drawing up of pasty substances. On each manipulation of the piston entailing the obtainment of the minimum volume of the chamber, one can cause a given quantity of the substance to be drawn up into the tube, which quantity will always remain the same in the course of time, even after the device has been used on numerous occasions.

SUMMARY OF THE INVENTION

The present invention therefore provides a drop dispenser comprising a reservoir for a substance to be dispensed drop-by-drop; a detachable stoppering device to be fitted on the reservoir to close it; and having a chamber and manipulating means for creating a partial vacuum in the said chamber and thus causing the substance to be drawn up into the tube when this tube is immersed in the said substance and for creating a compression in the said chamber and thus producing the drop-by-drop dispensing of the substance previously drawn up into the tube; and a tube connected to the stoppering device and having a lower end arranged to enter the reservoir when the stoppering device is fitted on the said reservoir, the tube having its upper portion opening out into the chamber of the stoppering device; wherein the chamber is delimited between, on the one hand, a fixed part of the stoppering device and joined to the upper portion of the tube and, on the other hand, a movable part of the stopping device constituting a piston sealingly slidable in relation to the fixed part under the control of the manipulating means, between a rest position in which the chamber has a maximum volume and an extreme working position where the chamber has a miniumum volume; and wherein elastic means are provided for restoring the movable part to its said rest position.

In accordance with a particularly advantageous mode of embodiment of the invention, the movable component of the chamber slides along the tube axis. In these conditions, the fixed part of the chamber is advantageously a cylindrical wall joined to a stoppering cap of the stoppering device, the said cap comprising a lateral skirt which carries assembly means complementary to corresponding means carried by the reservoir, for fitting the device on the said reservoir.

Preferably, the skirt of the cap is joined to the fixed cylindrical wall of the chamber via a transverse panel and is substantially coaxial in relation to the said cylindrical wall and to said tube. The seat joining the skirt of the cap and the fixed part of the chamber advantageously carries, between the skirt and the chamber, means for sealingly stoppering the reservoir.

In accordance with a first embodiment of the elastic means restoring the movable part of the chamber, the latter are disposed outside the fixed part of the chamber.

In the case where the skirt of the cap is joined to the fixed cylindrical wall of the chamber via a transverse panel, these elastic means are advantageously disposed between the panel of the cap and the manipulating means.

In accordance with a second embodiment of these elastic means, the latter are disposed in the zone occupied by the connection between the movable part of the chamber and the manipulating means within the fixed part of the chamber. In that case, the elastic means are advantageously integral with the movable part of the chamber and bear on a stop integral with the fixed part of the chamber.

According to a particular embodiment of the present invention, the stoppering device comprises a stop for the movable part of the chamber in the rest position of the piston.

When they conform to the above mentioned first embodiment, the manipulating means may consist of a helical spring surrounding the cylindrical fixed wall of the chamber and bearing, at one of its ends, against the transverse panel joining the skirt of the cap and the fixed part of the chamber and, at its outer end, against a bearing surface integral with the movable part of the chamber. In the case where provision has been made for a step for the movable part of the chamber in the piston rest position, the above mentioned manipulating means then advantageously consist of a push button integral with the piston, the said push button comprising an annular flange, one of whose sides constitutes the bearing surface against which the spring is applied and the other side of which bears against the stop comprised by the stoppering device.

In the above mentioned second embodiment, the elastic means may consist of a frustoconical element divergent in a direction away from the piston, the said element being joined at its lower edge to a rod connecting the piston to the manipulating means and bearing, at its free end, against a frustoconical bearing surface which is divergent in the same direction as the said element and is integral with the fixed parts of the chamber. Preferably, the frustoconical bearing surface is constituted by the external wall of the transverse panel joining the cap skirt fixed to the cylindrical wall of the chamber.

The reservoir may be a bottle provided with a neck, and the means ensuring leakproof stoppering may comprise an axial duct intended to be fitted with a tight grip in the outlet opening delimited by said neck.

According to one variant in the embodiment of these sealing means, they may comprise a frustoconical bearing surface flaring upwards, the said bearing surface being formed on the inner wall of the transverse panel joining the cap skirt and the cylindrical wall of the fixed chamber, said bearing surface being, moreover, capable of being brought to bear against a correspondingly shaped bearing surface formed on the internal edge of the reservoir opening.

The piston may comprise a peripheral skirt entering the fixed part of the chamber while bearing against its internal surface.

BRIEF DESCRIPTION OF THE INVENTION

In order that the present invention may more readily be understood, there will be described below two embodiments represented in the attached drawings by way of purely illustrative and non-restrictive examples. In these drawings.

DESCRIPTION OF THE PREFERRED EMBODIMENTS

Figure 1:
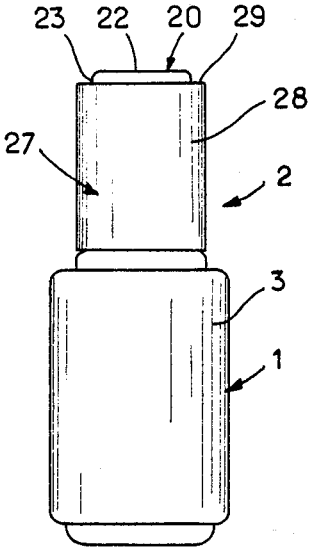
FIG. 1 is a view in elevation of a drop dispenser in accordance with a first embodiment of the invention, in the position where the bottle is closed by its stoppering capsule.
Figure 2:
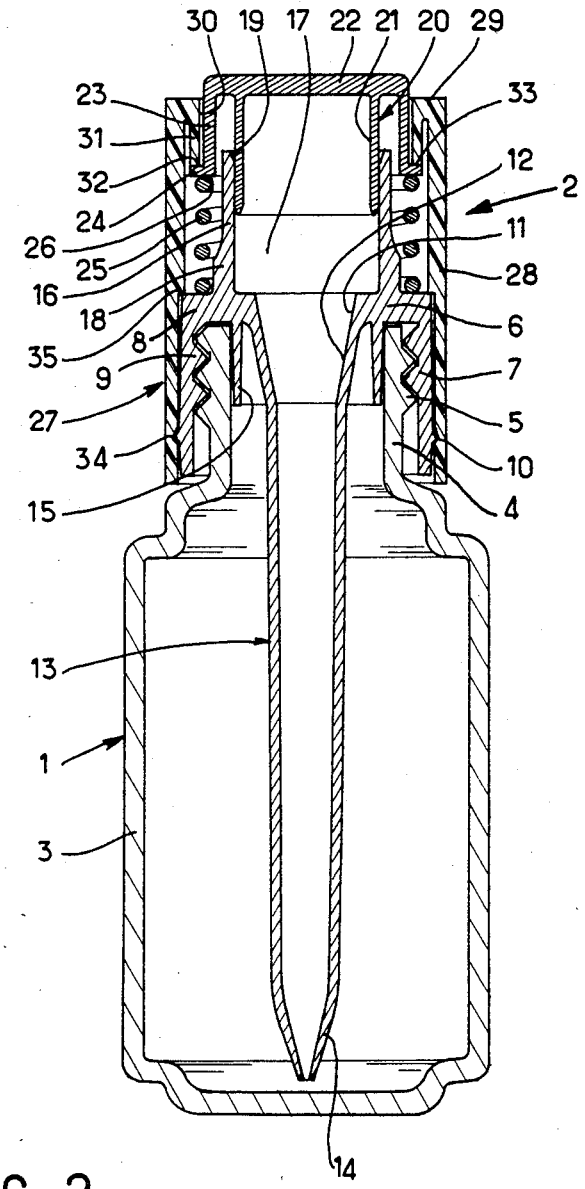
FIG. 2 is an axial cross sectional view of the unit of FIG. 1.

If reference is made to FIGS. 1 and 2, there will be seen a drop dispenser according to a first embodiment of the invention, this drop dispenser being constituted by a reservoir 1 wherein there is associated a stoppering device 2 which is represented in greater detail in FIG. 2.

Reservoir 1 consists of a bottle whose barrel 3 is joined at its upper portion to a neck 4 whose cylindrical wall carries externally a thread 5.

The stoppering device 2 comprises a stoppering cap 6 made of a relatively pliable plastic material such as polypropylene. This stoppering cap 6 is constituted by a cylindrical skirt 7 joined to a transverse panel 8. In the inner wall of skirt 7, there is arranged a thread 9 intended to come to cooperate with the thread 5 of neck 4 of reservoir 1. The external wall of skirt 7 has, near its free end, a peripheral retaining ring 10 whose function is indicated below.

The transverse panel 8 has a central opening 11 to which there is joined, via a frustoconical junction zone 12 divergent along a direction axially outwardly of the cap 6, a tube 13 with its lower end entering the reservoir 1 when device 2 is fitted on reservoir 1. Tube 13 is substantially cylindrical, its axis being identical with that of cap 6 and its wall being slightly constricted in its lower end zone 14.

The transverse panel 8 of cap 6 carries internally a cylindrical duct 15, centred on the axis of tube 13 and disposed between skirt 7 and the frustoconical zone 12, this cylindrical duct 15 being intended to penetrate within neck 4 of reservoir 1 and to cooperate with the inner wall of the said neck 4 to ensure the seal between the latter and capsule 6.

The transverse panel 8 of cap 6 carries externally a cylindrical wall 16 of the same axis as tube 13 and cap 6, the diameter of the cylindrical wall 16 being slightly greater than that of duct 15. Wall 16 delimits, with panel 8, the fixed part of a chamber 17 which is also delimited by a movable part described below. The inner surface of wall 16 is cylindrical. Moreover, wall 16 has, starting from its external surface, a greater thickness in its junction zone 18 with panel 8, and its inner free edge 19 is chamfered.

The movable part of chamber 17 consists of a piston designated by 20 as a whole. The piston 20, made of a relatively rigid plastics material such as polyethylene, is constituted by a skirt 21 penetrating within the space delimited by wall 16, coming to be deployed against the inner cylindrical surface of the said wall 16, this skirt 21 being joined to a flat top 22 which has a circular shape with a diameter greater than that of skirt 21. On the periphery of top 22, there is joined a second cylindrical skirt 23, coaxial with skirt 21, this skirt 23 having a diameter greater than that of the wall 16. Skirt 23 comprises, moreover, at its free end, an outward bend at right angles constituting a flange 24.

A metallic spring 25 surrounds the cylindrical wall 16 and bears, with one of its ends, on panel 8 of cap 6 and, with its other end, against the annular bearing surface 26 constituted by the corresponding surface of flange 24.

A metallic spring 25 surrounds the cylindrical wall 16 and bears, with one of its ends, on panel 8 of cap 6 and, with its other end, against the annular bearing surface 26 constituted by the corresponding surface of flange 24.

Around cap 6, is a covering cap 27 made for example of polypropylene or of a similar material. This cap 27 is constituted by a substantially cylindrical sleeve 28 joined to a top 29 having a central perforation 30, bordered by an internally cylindrical skirt 31 whose annular free edge constitutes a stop 32 for piston 20. The surface of the flange 24 which is on the side opposite to the side constituting the bearing surface 26 for spring 25, forms a second annular bearing surface 33 cooperating with the stop 32.

The circular opening 30 has, moreover, a diameter such that piston 20 can slide freely in this opening.

The internal surface of sleeve 28 has, near its free edge, an annular groove 34 intended to accommodate the peripheral retaining ring 10 carried by skirt 7 of cap 6. Moreover, sleeve 28 has on its inner wall a shoulder, disposed substantially at mid-height, which constitutes an annular bearing surface 35 intended to to bear against the external surface of panel 8 of cap 6.

The assembly of the elements constituting the stoppering device 2 is effected in a very simple manner. The spring 25 is placed on the cap 6, so that it comes to rest at one end of the panel 8 of the said cap 6 while surrounding the wall 16. Piston 29 is then placed on cap 6, so that its skirt 21 penetrates within the space delimited by the wall 16. The diameter of the wall 16 and that of skirt 21 are, moreover, calculated so that skirt 21 sealingly wipes the inner surface of the wall 16, while being able to slide along this wall. Then cap 27 is lowered around cap 6 until the retaining ring 10 of the cap 6 engages in the groove 34. At this moment, the bearing surface 35 substantially abuts the panel 8 of cap 6 and the bearing surface 33 of flange 24 bears against the stop 32 integral with cap 27. Moreover in this position, which is that represented in FIG. 2, the spring 25 is slightly compressed against the annular bearing surface 26.

The stoppering device 2 can then be attached to the reservoir 1 by screwing the skirt 7 of cap 6 on to the bottle neck 4.

The dispensing of the substance contained in reservoir 1 is effected as follows:

With the tube 13 dipped into the substance contained in reservoir 1, regardless of whether capsule 2 has already been unscrewed, the top 22 which serves as a push button is depressed, and this compresses the spring 25 and causes the skirt 21 to descend and hence to diminish the volume of chamber 17. The pressure that has been applied on the top 22 is then relaxed so the spring 25 then returns to its initial position which brings the piston 20 back into its rest position. A partial vacuum is then produced in chamber 17, causing some of the substance to be drawn up into the tube 13. This quantity can be easily calculated in advance, because the restoring force of the spring is known.

With the stoppering device 2 removed from the reservoir 1, it is then only necessary to press lightly on the top 22 to cause the piston 20 to descend into the fixed portion of the chamber 17, to produce a compression resulting in emergence of the substance drop-by-drop via the end 14 of the tube 13.

Figure 4:
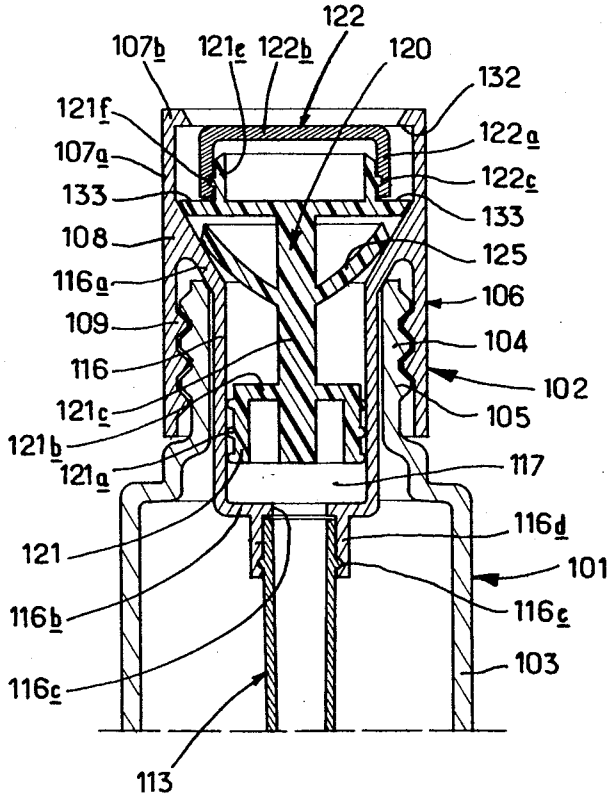
FIG. 4 is a view similar to FIG. 3, according to which the piston equipping the stoppering cap is represented in an intermediate working position.
Figure 3:
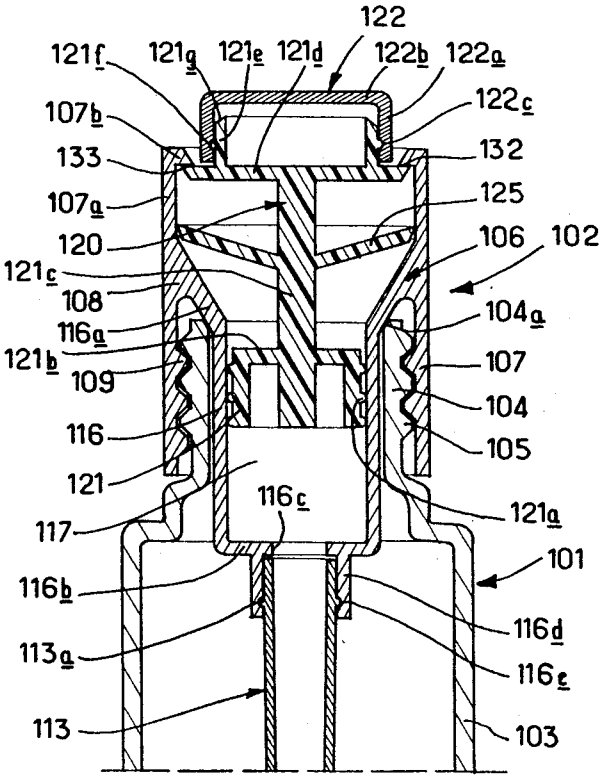
FIG. 3 is a view similar to FIG. 2, of a first variant of a drop dispenser of a second embodiment of the invention, only the upper part of the bottle having been shown.
Figure 5:
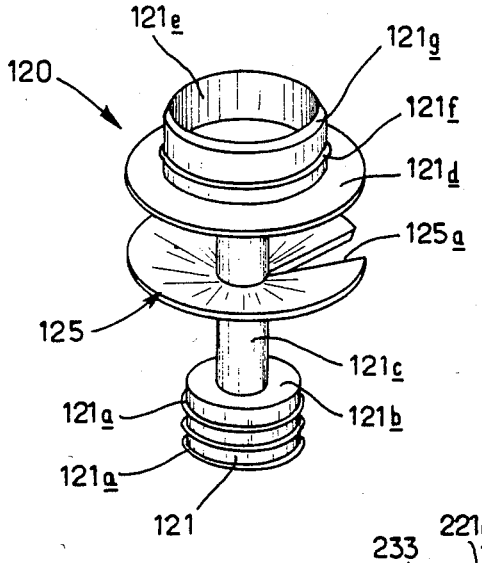
FIG. 5 is a perspective view of the piston of the drop dispenser of FIGS. 3 and 4; and , FIG. 6 is a view similar to FIG. 3 of a second variant of the drop dispenser of the second embodiment of the invention.

FIGS. 3 to 5 show a first variant of a second mode of embodiment of a drop dispenser according to the invention. This dispenser comprises a reservoir 101 which consists of a bottle onto which a stoppering device 102 can be fitted.

The barrel 103 of the bottle ends, in its upper portion, in a neck 104 having an external thread 105. The inner edge of the neck 104 is chamfered so as to constitute a substantially frustoconical bearing surface 104*a*.

The device 102 comprises a cap 106 constituted by a lateral skirt 107, and a seat 108 joined to the upper zone of the skirt 107. Skirt 107 has an internal thread 109 intended to cooperate with a thread 105 of the neck 104 of reservoir 101. Seat 108 has a large opening edged by a frustoconical wall 116*a* convergent along a direction towards the zone carrying the thread 109 and flaring divergent along the opposite direction (i.e. outwardly of this threaded zone). Wall 116*b* is intended to be applied on the frustoconical bearing surface 104*a* of neck 104.

At the lower edge of the frustoconical wall 116*a* is a cylindrical wall 116 coaxial with skirt 107. This wall 116 descends beyond the lower edge of skirt 107 where it is joined to a bottom wall 116*b* having a circular central opening 116*c*. Wall 116*b* supports a short skirt 116*d* which is directed outwardly of the recess enclosed by walls 116, 116*b*, the skirt 116*b* having internally near its lower edge an annular groove 116*e* whose function will be indicated below.

The walls 116*a*, 116 and 116*b* constitute the fixed part delimiting, with a movable part to be described below, a chamber 117.

The part 107*a* of the skirt 107 of capsule 116 has, at its upper portion, a part 107*b* bent inwardly at right angles such that it has an annular inner wall constituting a stop 132.

The cap 106 accommodates a tube 113, also made of polypropylene which has, near its upper portion, a peripheral retaining ring 113*a* intended to enter the groove 116*e* of skirt 116*d*. The lower portion of tube 113 is made in the same way as the tube 13 of FIG. 2.

The movable part delimiting the chamber 117 is constituted by a piston 120. The piston comprises a peripheral skirt 121 slidable within the compartment defined by wall 116; the skirt 121 carries externally several annular rings 121*a* which are applied against the inner surface of the wall 116, and thus ensure leakproof sliding of the piston 120.

The piston skirt 121 is joined to a radially extending wall 121*b* integral with a central stem 121*c* disposed coaxially of skirt 121. This stem 121*c* is connected, at its end remote from the skirt 121, to a circular disc 121*d* whose annular external surface constitutes a bearing surface 133 capable of abutting the stop 132 of the cap 106.

Disc 121*d* has an outwardly directed short cylindrical skirt 121*e* having an external peripheral retaining ring 121*f* and whose free external edge 121*g* is chamfered.

Connected to the stem 121*c*, between wall 121*b* and the disc 121*d*, is a spring 125 consisting of a frustoconical element integral with piston 120. This spring is shown in greater detail in FIG. 5. It is divergent towards the disc 121*d* and, when the elements constituting the stoppering device 102 are assembled, its free edge, which is chamfered, is able to abut the inner frustoconical surface 116*a*. As may be seen in FIG. 5, the spring 125 has a sector 125*a* cut away so as to allow the displacement of the said spring 125 along the frustoconical wall 116*a*.

Device 102 finally comprises a push button 122 comprising a peripheral skirt 122*a* and an integral top panel 122*b*, the skirt 122*a* having an internal annular groove 122*c* to receive the peripheral bead 121*f* described above.

The assembly of the device of FIGS. 3 and 4 is effected as follows. The push button 122 is mounted on piston 120 by catch-engaging the peripheral retaining ring 121*f* in the groove 122*c* provided for this purpose. Then, this assembly is introduced into the cap 106 so that the skirt 121 bears against the inner surface of wall 116. Tube 113 is then fixed by catch-engagement of the retaining ring 113*a* in groove 116*e*. By virtue of this position, which is the one represented in FIG. 3, the spring 125 is already in a stressed condition with its free end abutting the wall of cap 106.

The functioning of this device is similar to that of FIGS. 1 and 2. The position in which the piston penetrates inside the compartment defined by wall 116 is represented in FIG. 4 where the spring 125 is shown in an almost fully strained position.

It is also possible, in this embodiment, to estimate the quantity of liquid which may be drawn up on each manipulation of the piston 120.

Figure 6:
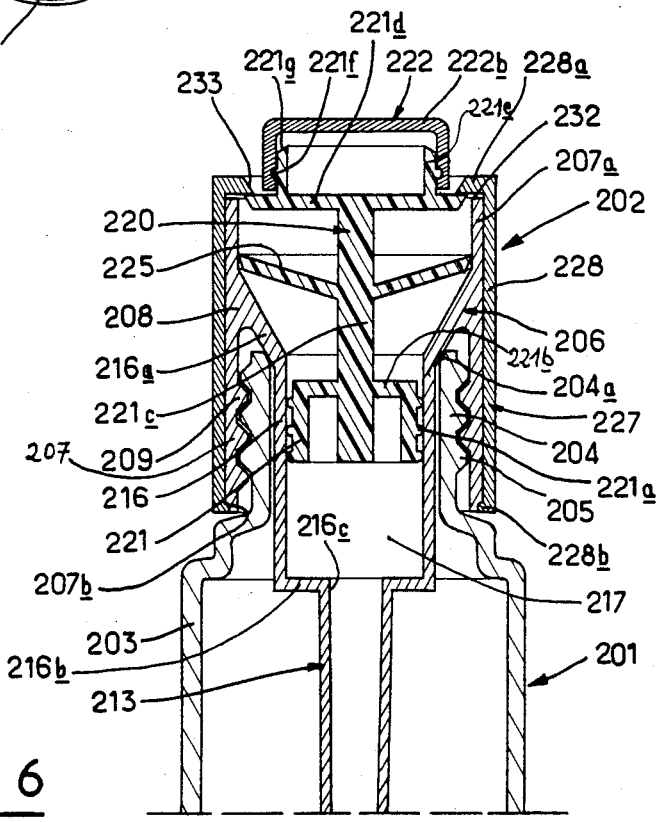

The device according to the second variant of the second embodiment, which is represented in FIG. 6, is substantially analogous to that of FIGS. 3 to 5.

The corresponding elements have been represented by reference numbers having 100 added to those used for the variant of FIGS. 3 to 5. Below, there will only be described the differences between those two variants.

Tube 213 integral with the capsule 206, is therefore directly connected to an opening 216*c* in the bottom wall 216*b* delimiting the chamber 217. Moreover, part 207*a* of skirt 207 does not have any inward bend since the stop 232 is here constituted by the internal wall of a bend at right angles on the upper edge of a sleeve 228 which, in the assembled position of the device 202, comes to surround skirt 207 and its extension 207*a*. Sleeve 228 and its right angled bend 228*a* constitute a presentation cap 227. It will be noted, moreover, that sleeve 228 has in its lower portion a bead 228*b* to be catch-engaged in an external groove 207*b* of the skirt 207.

The assembly of the device 202 differs from that of device 102 only in that, after connection of piston 220 and push button 222 mounting of the combination within the cap 206, the outer presentation cap 227 is caused to slide over the skirt 207 and its extension 207*a*, until catch-engagement of the bead 228*b* in groove 207*b*.

The functioning of this variant of the embodiment is strictly identical with that of the preceding variant.

I claim:

1. In a drop dispenser comprising:

(a) a reservoir for a substance to be dispensed;

(b) a detachable stopper means adapted to be fitted on said reservoir;

(c) said detachable stopper means including means defining a chamber;

(d) a tube having a proximal end connected to the stopper means, said tube having its distal end entering the reservoir when the stopper means is fitted on said reservoir and having its proximal end opening into said chamber of the stopper means;

(e) manipulating means for creating a partial vacuum in the said chamber while the tube is immersed in the said substance and thus causing the substance to be drawn up into the tube and for creating a compression in said chamber and thus producing the drop-by-drop dispensing of the substance previously drawn up into the tube;

the improvement comprising:

(f) a fixed part integral with the stopper means and joined to the proximal portion of said tube;

(g) said stopper means having a movable piston sealingly slidable in relation to said fixed part under the action of said manipulating means, between a first position wherein the chamber has a maximum volume and a second position where the chamber has a minimum volume, said chamber being delimited by said fixed part and said piston of said stopper means; and (h) elastic means for biasing said piston towards said first position;

said piston being slidable along a direction coaxial with said tube, said fixed part of said chamber comprising a cylindrical wall, said stopper means further including a stopper cap joined to said fixed part, wherein said stopper cap comprises a lateral skirt and fitting means to said skirt; and wherein said reservoir includes further fitting means complementary to said fitting means of said stopper cap and engageable therewith to allow fitting of said stopper means on said reservoir, said stopper cap including a transverse panel joining said skirt of said stopper cap to said cylindrical wall of said fixed part of said chamber, said skirt being substantially coaxial in relation to said cylindrical wall and to said tube connected thereto, said elastic means for biasing said piston of said chamber being disposed outside said fixed part of said chamber, said elastic means being disposed between said transverse panel of said cap and said manipulating means.

2. The dispenser as claimed in claim 1 wherein said transverse panel of said stopper cap has said cylindrical wall extending therefrom towards said manipulating means, said elastic means comprising a helical spring surrounding said cylindrical fixed wall, said piston having a bearing surface formed integrally therewith with said spring having a first end bearing against said transverse panel and a second end butting against said bearing surface formed integrally with said movable piston.

3. A dispenser according to claim 2, wherein said stopper means includes a stop member for said piston in said first position of the piston and wherein the manipulating means comprises a push button fixed to said piston, the said push button comprising an annular flange having a first side which constitutes a bearing surface for said spring and having a second surface which bears against said stop member of the stopper means.

4. In a drop dispenser comprising:

(a) a reservoir for a substance to be dispensed;

(b) a detachable stopper means adapted to be fitted on the reservoir;

(c) said detachable stopper means including means defining a chamber;

(d) a tube having a proximal end connected to the stopper means, said tube having its distal end entering the reservoir when the stopper means is fitted on said reservoir and having its proximal end opening into said chamber of said stopper means;

(e) manipulating means for creating a partial vacuum in the said chamber while the tube is immersed in the said substance and thus causing the substance to be drawn up into the tube and for creating a compression in said chamber and thus producing the drop-by-drop dispensing of the substance previously drawn up into the tube;

the improvement comprising:

(f) a fixed part integral with said stopper means and joined to the proximal end of said tube;

(g) said stopper means having a movable piston sealingly slideable in relation to said fixed part under the action of said manipulating means, between a first position wherein the chamber has a maximum volume and a second position where the chamber has a minimum volume, said chamber being delimited by said fixed part and said piston of said stopper means; and (h) elastic means for biasing said piston towards said first position; said elastic means being disposed in a zone occupied by the junction between said movable piston and said manipulating means within said chamber, said dispenser including a stop integral with said fixed part of the chamber, said elastic means being integral with said movable piston and bearing on said stop, said dispenser including a stopper cap having a frustoconical bearing surface, said elastic means comprising a frustoconical element flaring in a direction away from said piston, and a stem joined to a lower edge of said element, wherein said element bears its free edge against said frustoconical bearing surface which is flared in the same direction as said element and is integral with said fixed part of said chamber.

5. A dispenser as claimed in claim 4 wherein said stopper cap includes a skirt, a transverse panel joining said skirt to said fixed part of said stopper means, said fixed part including a cylindrical wall defining, in part, said chamber, said skirt being substantially coaxial in relation to said cylindrical wall and to said tube connected to said stopper means, said frustoconical bearing surface being constituted by an internal wall joining said skirt to said cylindrical wall of said chamber.

* * * * *